United States Patent [19]

Kmak

[11] 4,214,976

[45] Jul. 29, 1980

[54] METHOD FOR REMOVING CORONENE FROM HEAT EXCHANGERS

[75] Inventor: Walter S. Kmak, Scotch Plains, N.J.

[73] Assignee: Exxon Research & Engineering Co., Florham Park, N.J.

[21] Appl. No.: 9,228

[22] Filed: Feb. 2, 1979

[51] Int. Cl.[2] ..... C10G 9/16; C10G 39/00; C07C 15/12

[52] U.S. Cl. ..... 208/48 R; 203/4; 203/87; 208/DIG. 1; 208/62; 208/95; 208/134; 208/212; 585/950

[58] Field of Search ..... 208/48 R, 62; 203/87, 203/4; 585/320, 950

[56] References Cited

U.S. PATENT DOCUMENTS

| | | | |
|---|---|---|---|
| 1,672,801 | 6/1928 | Buerger | 208/48 R |
| 2,953,514 | 9/1960 | Wilkins | 208/95 |
| 3,322,842 | 5/1967 | Czajkowski et al. | 585/488 |
| 3,619,407 | 11/1971 | Hendricks et al. | 208/48 R |
| 3,725,247 | 4/1973 | Johnson et al. | 208/111 |
| 3,793,182 | 2/1974 | Ward | 208/111 |

*Primary Examiner*—Delbert E. Gantz
*Assistant Examiner*—G. E. Schmitkons
*Attorney, Agent, or Firm*—Marthe L. Gibbons

[57] ABSTRACT

Coronene deposits are removed from a heat exchange zone disposed in two parallel trains of heat exchangers in a reforming process by reducing the flow of reforming zone effluent in one of the trains of heat exchangers sufficiently to effect condensation of a portion of the reforming zone effluent in said one train of heat exchangers where the coronene is deposited while simultaneously increasing the flow of reforming zone effluent in the second train of heat exchangers. Control means are provided in each of the heat exchange trains.

8 Claims, 1 Drawing Figure

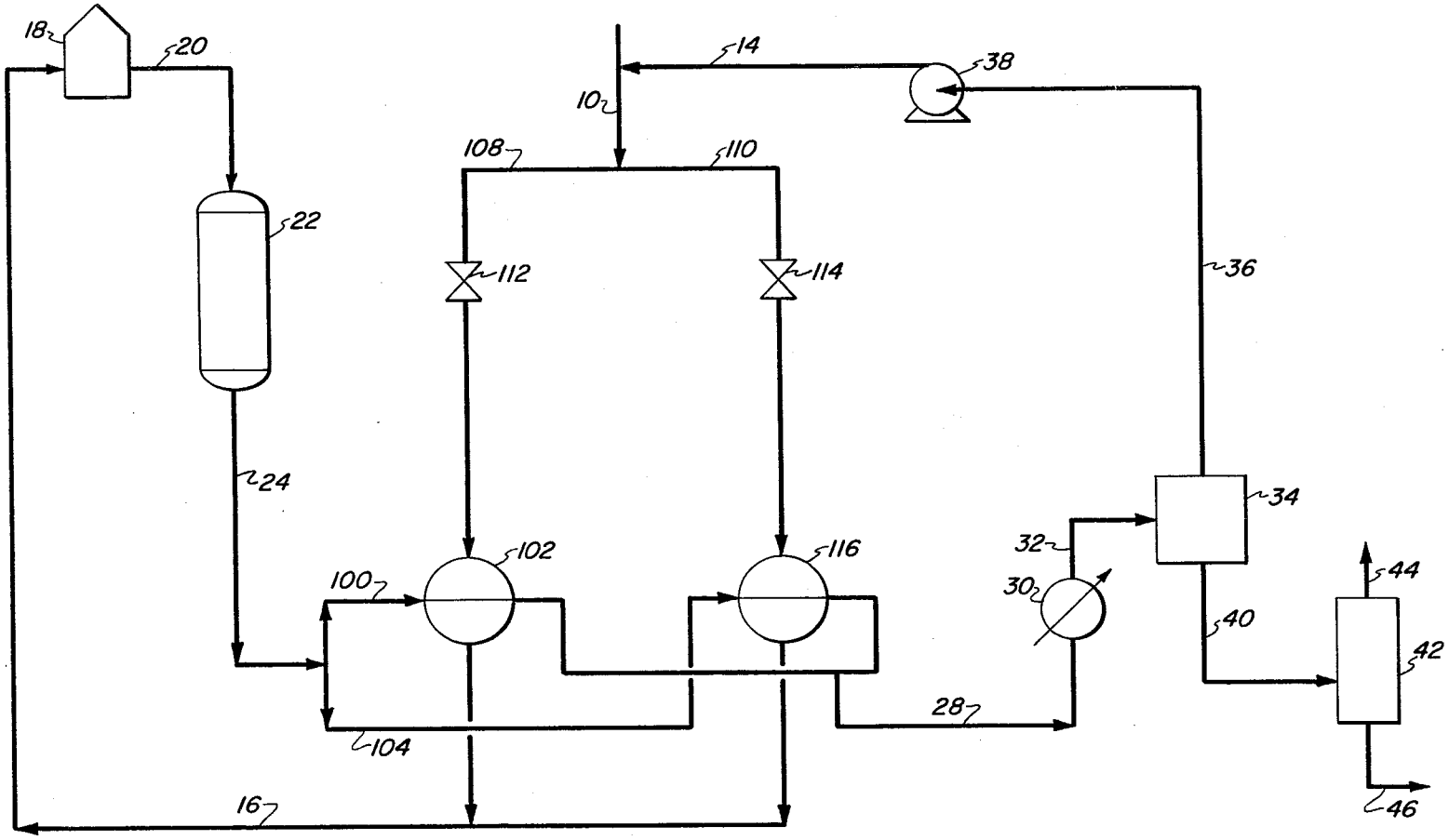
18
20
22
24
16
100
104
102
108
112
10
110
114
116
14
38
36
28
32
30
34
40
42
44
46

METHOD FOR REMOVING CORONENE FROM HEAT EXCHANGERS

BACKGROUND OF THE INVENTION

1. Field of the Invention

The present invention relates to a method of removing coronene deposits from a heat exchange zone of a reforming process.

2. Description of the Prior Art

Reforming is a well-known process in which a hydrocarbonaceous feedstock, such as naphtha, is contacted at elevated temperature and pressure in the presence of added hydrogen with the solid catalyst to increase the aromaticity of the feedstock. See, for example, *Hydrocarbon Processing,* Sept. 176, pp. 171–178. The effluent of the reforming zone comprises undesired polycyclic aromatic compounds, including coronene, in amounts which vary depending on the operating conditions. Coronene ($C_{24}H_{12}$) is a polycyclic aromatic compound having a structure which contains 7benzene rings in a circular pattern with no side chains. Its molecular weight is 300 and its melting point is 440° C. Because of its high melting point, when coronene is present in relatively high concentrations, coronene readily deposits as a solid upstream of the effluent dew point in the heat exchanger used to cool the effluent.

U.S. Pat. No. 3,322,842 discloses recycling a portion of the gasoline reformate to the total reaction effluent prior to separating the reaction product into gaseous phase and liquid phase to minimize catalyst deactivation caused by polycyclic aromatic compounds such as coronene.

U.S. Pat. No. 1,672,801 discloses the use of solvent, such as naphtha, to dissolve asphalt in clogged draw-off pipes or separation zones of hydrocarbon conversion processes.

U.S. Pat. No. 3,725,247 discloses that polynuclear aromatics which have a deleterious effect on the catalysts are formed during hydrocracking. It teaches treatment of the catalyst to avoid formation of polyaromatic compounds.

U.S. Pat. No 2,953,514 relates to a method for reducing heat exchanger fouling. It discloses injecting a portion of the liquid reformate boiling at least about 450° F. in the stream of the reactor effluent at a point upstream of the heat exchanger.

It has now been found that in a reforming process wherein the reforming zone effluent is passed into two parallel trains of heat exchangers, by reducing the flow of reforming zone effluent in one of the trains of heat exchanger to a temperature sufficient to condense at least a portion of the reformate therein while increasing the flow in the other train of heat exchanger, the coronene deposition can be removed from the first train of heat exchangers.

SUMMARY OF THE INVENTION

In accordance with the invention there is provided a method for removing coronene deposits in a reforming process which comprises steps of (a) contacting a hydrocarbonaceous feedstock with a catalyst in the presence of added hydrogen at reforming conditions in a reforming zone; (b) splitting the total reforming zone effluent into a first stream and a second stream; (c) passing the first stream into a first train of heat exchangers arranged in parallel with a second train of heat exchangers; (d) passing said second stream into said second train of heat exchangers, said reforming zone effluent comprising coronene, at least a portion of which deposits in said heat exchangers; (e) separating the heat exchanged total reforming zone effluent into a hydrogen-rich gaseous phase and a liquid hydrocarbon phase comprising normally liquid hydrocarbons and normally gaseous hydrocarbons, the improvement which comprises reducing the flow of said first stream in said first train of heat exchangers to produce a temperature sufficient to condense at least a portion of said reformer effluent therein such that the resulting condensate contacts said coronene deposit, and simultaneously increasing the flow of said second stream in said second train of heat exchangers.

BRIEF DESCRIPTION OF THE DRAWINGS

The FIGURE is a schematic flow plan of one embodiment of the invention.

DESCRIPTION OF THE PREFERRED EMBODIMENT

The preferred embodiment will be described with reference to the accompanying drawing. Referring to the drawing, a conventional reformer feed is carried by line 10 and is split into two streams, that is stream 108 which enters the shell of heat exchanger 102 and stream 110 which enters the shell of heat exchanger 106. Control means such as butterfly valves 112, 114 are provided to control the flow of each heat exchanger or train of heat exchangers. At least one control means is provided in each heat exchanger or train of heat exchangers either at the inlet or at the outlet of the respective exchangers. If flow is reduced in the first heat exchanger or series of heat exchangers, the temperature of the fouled heat exchanger is cooled to produce condensation of the reformate in the heat exchanger at a point where the coronene deposit is located or at a point upstream of the coronene deposit to dissolve the coronene deposit in the heat exchanger. Simultaneously, the flow is increased in the second exchanger (or series of heat exchangers) so that the temperature of the fouled second heat exchanger is increased. This results in some sublimation of the deposited coronene and redeposition of the coronene further downstream. Subsequently, the flow conditions are reversed with flow reduced in the second train, thereby producing condensation of reformate and dissolution of coronene therein.

A hydrogen-rich recycle gas is introduced into line 10 via line 14. Suitable reforming feeds include naphtha having atmospheric boiling point ranging from about 80 to about 450, preferably from about 150° to 235° F. Generally, the feed is substantially sulfur-free, that is, the feed comprises less than about 25 wppm, preferably less than 10 wppm sulfur. In the shell of the heat exchangers, a naphtha feed and hydrogen-rich gas are partially preheated and passed via line 16 to furnace 18 in which the mixture of naphtha feed and hydrogen-rich gas is additionally heated to reforming reaction temperature. The heated stream is passed via line 20 into reforming reactor 22 in which is disposed a bed of reforming catalyst. The reforming catalyst may be any of the known reforming catalysts. Suitable reforming catalysts include metal such as platinum or palladium, oxides and sulfides of certain metals such as molybdenum, chromium, vanadium and tungsten. The catalysts may be a multi-metallic catalyst such as platinum, rhenium or iridium composited with a suitable support such as alumina. The catalyst may comprise a halogen component such as chlorine. Conventional reforming conditions include a temperature ranging from about 750° to 1050° F., a pressure ranging from about 50 to about 600 psig, a space velocity (volumes of liquid feed per volume of catalyst per hour) of from 0.5 to 10. The reforming reaction is conducted in the presence of added hydrogen or added hydrogen-rich gas. The hydrogen concentration can vary from about 1000 to about 10,000 standard cubic feet per barrel of reformer feed. During the reforming process, naphthenes are dehydrogenated to the corresponding aromatics, paraffins are isomerized and aromatized, olefins are hydrogenated, and some hydrocracking of high boiling constituents occurs. The reforming reaction also produces hydrogen. Undesired polycyclic aromatics such as coronene are produced in the reforming reaction. The coronene content in the effluent may vary from about 0.1 to about 20 wppm. When the content of coronene in the reformer effluent is relatively high, that is at least 0.5 wppm, coronene may precipitate from the effluent to the surfaces of the heat exchanger. The effluent of the heat exchanger is passed via line 28 through cooler 30 and then via line 32 to a separation zone 34 wherein the effluent is separated by conventional means into a gaseous phase and liquid phase. The gaseous phase rich in hydrogen is removed from separation zone 34 via line 36, passed through compressor 38 and recycled via line 14 into reformer feed line 10. The liquid hydrocarbon phase comprising aromatics, light paraffins, olefinic hydrocarbons and butanes withdrawn from separator 34, passed by line 40 into separation zone 42 wherein light paraffins, olefinic hydrocarbons and at least a portion of the butanes are removed via line 44. The remaining liquid reformate product (stabilized reformate) is removed via line 46.

What is claimed is:

1. A method for removing a coronene deposit in a reforming process which comprises the steps of:

(a) contacting a hydrocarbonaceous feedstock with a catalyst in the presence of added hydrogen at reforming conditions in a reforming zone;

(b) splitting the total reforming zone effluent into a first stream and a second stream;

(c) passing said first stream into a first train of heat exchangers arranged in parallel with a second train of heat exchangers;

(d) passing said second stream into said second train of heat exchangers, said reforming zone effluent comprising coronene, at least a portion of which deposits in said heat exchangers;

(e) separating the heat exchanged total reforming zone effluent into a hydrogen-rich gaseous phase and a liquid hydrocarbon phase comprising normally liquid hydrocarbons and normally gaseous hydrocarbons, the improvement which comprises reducing the flow of said first stream in said first train of heat exchangers to produce a temperature sufficient to condense at least a portion of said reformer effluent therein such that the resulting condensate contacts said coronene deposit, and simultaneously increasing the flow of said second stream in said second train of heat exchangers.

2. The method of claim 1 wherein control means are provided in each of said first and said second trains of heat exchangers.

3. The method of claim 2 wherein said control means comprise at least one butterfly valve disposed in each of said first and said second trains of heat exchangers.

4. The method of claim 1 wherein said coronene is present in said total reforming zone effluent in an amount of at least 0.5 wppm prior to step (b).

5. The method of claim 1 wherein said hydrocarbonaceous feedstock has an atmospheric pressure boiling point ranging from about 80° to about 450° F.

6. The method of claim 1 wherein said hydrocarbonaceous feedstock has an atmospheric pressure boiling point ranging from about 150° to about 375° F.

7. The method of claim 1 wherein said coronene removal is conducted intermittently in said reforming process.

8. The method of claim 1 wherein the flow of reformer effluent is reduced in said second train of heat exchangers whereby the flow of reformer effluent is increased in said first train of heat exchangers.

* * * * *